US005433590A

United States Patent [19]

Klaus et al.

[11] Patent Number: 5,433,590

[45] Date of Patent: Jul. 18, 1995

[54] COOLING DEVICE FOR THE LUBRICATION CIRCUIT OF A COMPRESSOR

[75] Inventors: Hossner Klaus, Wimsheim; Stenzel Adalbert, Stuttgart, both of Germany

[73] Assignee: Bitzer Kuhlmaschinenbau GmbH & Co.KG, Sindelfingen, Germany

[21] Appl. No.: 167,874

[22] PCT Filed: May 13, 1992

[86] PCT No.: PCT/EP92/01045

§ 371 Date: Dec. 21, 1993

§ 102(e) Date: Dec. 21, 1993

[87] PCT Pub. No.: WO93/01413

PCT Pub. Date: Jan. 21, 1993

[30] Foreign Application Priority Data

Jul. 11, 1991 [DE] Germany ..... 41 22 889.8

[51] Int. Cl.[6] ..... F01C 21/04; F04B 49/10

[52] U.S. Cl. ..... 418/85; 418/2; 418/84; 418/86; 417/278; 184/6.22; 62/192

[58] Field of Search ..... 418/85, 2, 84, 86; 417/278; 184/6.22; 62/84, 192, 468, 505

[56] References Cited

U.S. PATENT DOCUMENTS 3,176,913 4/1965 Sorg et al. ..... 418/85
3,710,590 1/1973 Kocher ..... 418/85
3,759,348 9/1973 Kasahara ..... 418/97

FOREIGN PATENT DOCUMENTS 0306405 3/1989 European Pat. Off. .
2261091 6/1973 Germany .
2801408 1/1979 Germany .
2287058 11/1990 Japan .

*Primary Examiner*—Richard A. Bertsch
*Assistant Examiner*—Charles G. Freay
*Attorney, Agent, or Firm*—Shenier & O'Connor

[57] ABSTRACT

In a cooling device for a rotary piston compressor, in particular a screw-type compressor, which is part of a refrigerant circuit together with a condenser and an evaporator, coolant of the refrigeration system and oil serving to lubricate bearings as well as to cool and seal the screw-type compressor are injected into the screw-type compressor. In order to cool the oil serving to lubricate the compressor bearings separately and to thereby achieve a more economical functioning of the entire cooling device, it is suggested that only the part of the oil serving to lubricate the bearings of the compressor is cooled as a function of the oil temperature sensed behind the bearings and that a branched stream of coolant is used for this, the stream on its part subsequently being fed to the compressor again.

8 Claims, 1 Drawing Sheet

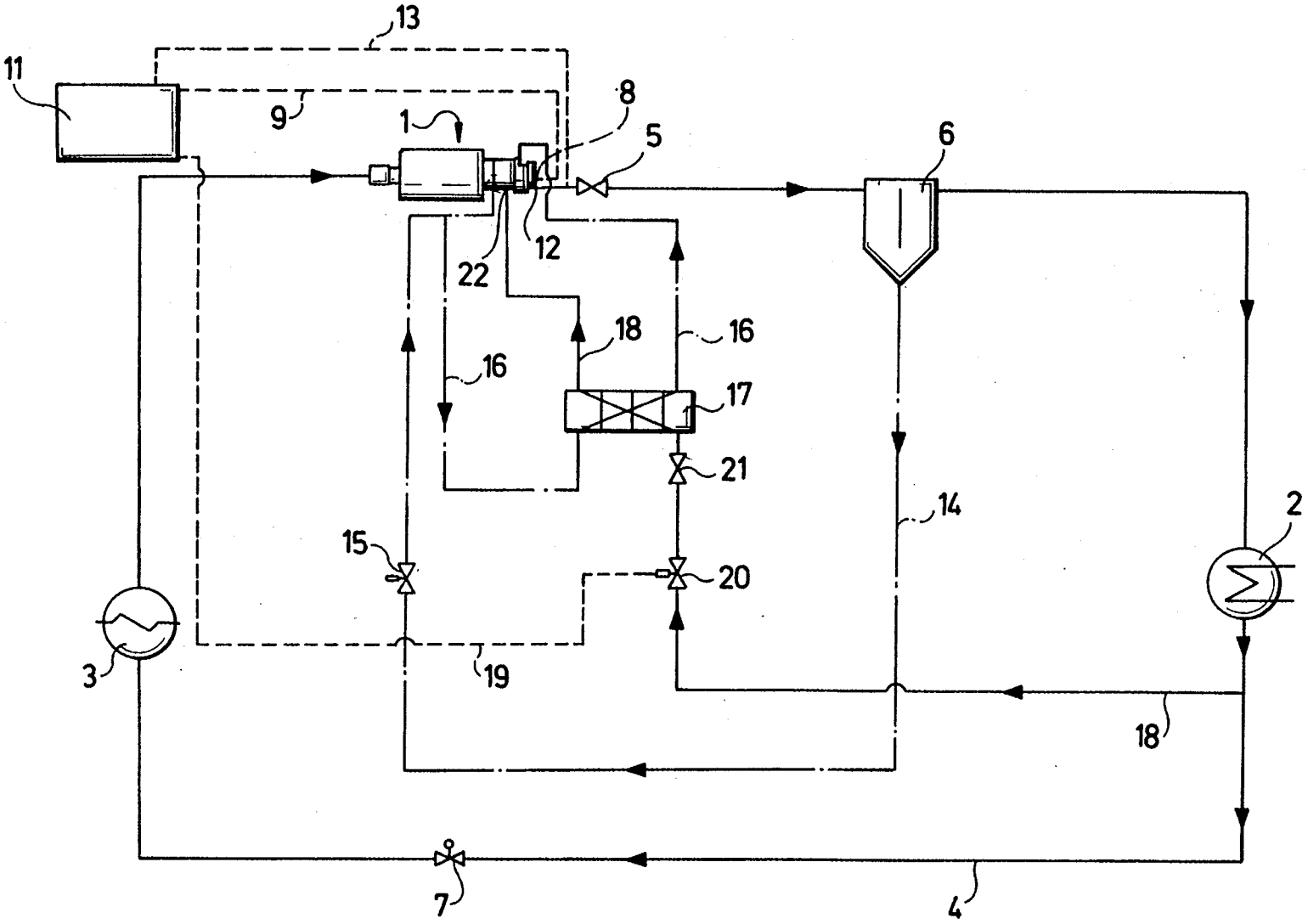
2
18
4
6
14
16
17
21
20
5
8
18
12
22
16
19
7
1
13
15
9
3
11

COOLING DEVICE FOR THE LUBRICATION CIRCUIT OF A COMPRESSOR

The invention relates to a cooling device for a screw type compressor.

BACKGROUND OF THE INVENTION

Cooling devices of this type can be used in rotary piston compressors for refrigeration and air-conditioning systems, for example in a screw-type compressor with oil injection. Refrigeration and air-conditioning systems essentially comprise an evaporator in which heat is withdrawn from the environment by evaporation of the coolant, a compressor which increases the pressure of the vaporized coolant from a suction pressure to an outlet pressure, and a condenser in which the vaporized coolant under the discharge pressure is liquefied again under heat emission.

In screw-type compressors, two screw-like rotors meshing with each other are arranged within the compressor casing for compressing the coolant, these rotors being tightly sealed radially by the compressor casing. In most cases, the screw-type compressors or worm compressors used in refrigeration systems have a means for oil injection. The oil is injected into the compression spaces of the screw-type compressors and thus into the gas to be compressed which is located therein. This serves essentially the following three purposes:

1. For cooling the compression process: By means of the injected oil, the coolant to be compressed is cooled and with that, the screw-type compressor as a whole is also cooled. It is thereby subjected to smaller temperature differences. This means that fittings and tolerances can be carried out more closely, whereby the clearance losses in the compressor are decreased.
2. For lubricating the rotors and the bearings: Since in known oil-injected screw-type compressors only one of the rotors is usually driven externally, for example by an electric motor or the like, the other rotor must be driven indirectly by and together with the driven rotor. The injected oil thereby decreases the wear and tear at the two rotors. Besides this, the oil is used for lubricating the bearings of the rotors.
3. For sealing the clearances within the compression space: The injected oil seals the clearances between the two rotors and between the individual rotors and the compressor casing. In this manner, possibly existing leakage paths within the compressor are sealed and thus the conditions for a high degree of efficiency of the compressor are created. The oil injected into the compression chamber is vaporized and is carried along by the gaseous coolant to be compressed which is located in the compression chamber. Thus, there is an oil-coolant mixture at the pressure outlet of the compressor. The oil found in the oil-coolant mixture must be separated from the coolant by oil separators in order to be injected again into the compressor and so that heat transmissions of the coolant within the refrigerating circuit are not influenced unfavourably.

When compressing to high pressures, the oil injected into the compressor is cooled as a function of a final temperature resulting at the pressure outlet of the compressor. Thereby, cooling can take place by means of coolant injection, or by cooling with water or with air in a heat exchanger, e.g. a plate-type heat exchanger. A large quantity of injected oil necessitates large and expensive heat exchangers in the latter case.

The temperature of the injected oil is essentially determined in that its viscosity is great enough to ensure lubrication of the bearings. When the oil temperature increases, then the viscosity of the oil decreases and the lubrication of the bearings of the rotors is endangered. For the above-mentioned sealing of the clearances, which requires the greatest quantity of injected oil, also lower oil viscosities or higher oil temperatures, however, would be allowable.

SUMMARY OF THE INVENTION

The object of the invention is to controllably cool the oil used for lubricating the bearings in a simple and economical manner, independent of the total quantity of oil injected into the compressor.

BRIEF DESCRIPTION OF THE DRAWINGS

The following description of a preferred embodiment of the invention serves to explain the invention in Greater detail in conjunction with the attached drawing which schematically shows a cooling device.

DESCRIPTION OF THE PREFERRED EMBODIMENT

As represented, a cooling device essentially comprises a screw-type compressor 1, a condenser 2 and an evaporator 3 which are connected in a closed refrigerant circuit by lines 4. Further, in the refrigerant circuit is a check valve 5 which is arranged directly at the pressure outlet of the compressor, an oil separator 6 which is arranged behind the check valve 5 and in front of the condenser 2, as well as an expansion member 7 which is located between the condenser 2 and the evaporator 3 in the refrigerant circuit.

Two temperature sensors 8 and 12 which cannot be seen individually are arranged in the compressor 1. A first temperature sensor 8 senses the temperature at the bearings of the compressor 1 and is connected with a control unit 11 via an electric line 9. A second temperature sensor 12 senses the temperature in the pressure outlet area of the compressor 1 and is also connected with the control unit 11 via an electric line 13.

A main oil line 14 proceeds from the oil separator 6, the oil line leading into the compression space of the compressor 1 via a solenoid valve 15. From the main oil line 14, a bearing oil line 16 is branched off and leads into a heat exchanger 17 and from this to the bearings of the compressor 1.

Behind the condenser 2, a part of the coolant is branched off via a line 18 from the line 4 of the refrigerant circuit, supplied to a solenoid valve 20 controllable via an electric line 19 by the control unit 11 and from this valve via an injection nozzle 21 enters the heat exchanger 17 from which it is supplied to a point 22 of the compressor 1 at which the suction process of the compressor 1 activated by the rotors is concluded.

The mode of operation of the cooling device is as follows: The coolant vaporized in the evaporator 3 is sucked in at the suction side of the compressor 1 and is compressed therein. Oil is injected into the compression space of the compressor via the main oil line 14 and the solenoid valve 15. The oil is carried along by the coolant to be condensed and the oil-coolant mixture resulting in this manner is supplied in its condensed state to the oil separator 6 via the check valve 5. In the oil separator 6, the oil is separated from the coolant and, since it is under increased pressure, is injected again into the compressor 1 via the main oil line 14 and the solenoid valve 15 at a point of this compressor which is under lower pressure. The oil is separated from the coolant so that the heat transmissions of the coolant within the refrigerant circuit are not adversely affected and, in addition, to realize a closed main oil circuit.

When the temperature in the compressor 1 increases, which effects a temperature rise at the bearings of the rotors of the compressor 1, then the viscosity of the oil decreases, especially also the oil which is found in the bearings. When a critical temperature at which the viscosity of the oil at the bearings has Greatly decreased, is exceeded, which is determined behind the bearings by the temperature sensor 8, then the solenoid valve 20 is opened by the control unit 11 via the electric line 19 and coolant in liquid form is injected into the heat exchanger 17 via the line 18 and the injection nozzle 21. In the heat exchanger 17, the oil branched off from the main oil line 14 via the bearing oil line 16 for cooling the bearings is cooled by the coolant branched off behind the condenser 2, whereby heat is supplied to the coolant and heat is withdrawn from the oil used for lubricating the bearings. The coolant thereby vaporised in the heat exchanger 17 is supplied to the suction side of the compressor, advantageously at a point 22 at which the suction process of the compressor 1 is concluded. The injection at this point 22 of the compressor 1 is necessary because otherwise the refrigeration capacity of the compressor, i.e. the amount of heat absorbed from the surroundings for vaporizing the coolant in the evaporator 3, decreases because the coolant branched off for cooling the oil serving as bearing lubricant does not contribute to the heat transmission in the evaporator 3. Furthermore, injecting the coolant at the point 22 of the compressor 1 results in the advantage that the coolant coming from the heat exchanger 17 meets with the partially compressed, warmer coolant in the compressor 1 and thereby cools down the latter, which leads to an advantageous, lower final compression temperature.

Should the final compression temperature still exceed a predetermined limiting value, then the solenoid valve 20 is opened by means of the control unit 11 via the electric line 13 with the second temperature sensor 12 located in the pressure outlet area of the compressor 1 and by means of the injection nozzle 21, more coolant is injected into the heat exchanger 17 than is necessary for cooling the oil serving to lubricate the bearings.

Should the final compression temperature increase further even when the solenoid valve 20 is constantly open, then by means of the temperature sensor 12 or by a further temperature sensor, not illustrated, in the pressure outlet area of the compressor 1, a switching off of the compressor is achieved via the control unit 11.

The cooling of the oil used for bearing lubrication described above offers the advantage of using oil of lower intrinsic viscosity. Previously, the demand for high intrinsic viscosity was determined especially by the lubrication of the bearings of the compressor, since a sufficient operation viscosity of the oil at the bearings is necessary at high bearing temperatures. On the "cold side" of the refrigerant circuit, the use of oil having a high intrinsic viscosity could, however, cause problems. At low evaporation temperatures, the oil which is not separated by the oil separator and, therefore, located in the refrigerant circuit becomes so viscous that it is no longer taken along by the stream of gaseous coolant in the evaporator. In this manner, a displacement of oil in the evaporator results, which can lead to a decreased heat transmission of the gaseous coolant, for example at evaporation pipes of the evaporator, or even lead to individual blocking of such pipes.

When, however, an oil of lower viscosity is used, then all the oil injected into the compressor in known cooling devices has to be cooled in order to maintain the necessary operation viscosity at the bearings. Such cooling of all the injected oil is, however, subject to limits since too great a decrease of the final compression temperature which is hereby effected, can lead to the fact that this comes close to the condensation temperature and that coolant is already condensing in the oil separator. Besides this, the oil-coolant mixture has an essentially lower viscosity than the pure oil and is no longer sufficient for the lubrication of the bearings since the coolant suddenly evaporates out of the oil at the warm bearings and in this manner interrupts the lubricating film at the bearings. The greater quantity of coolant in the oil also has disadvantages with respect to energy. This coolant must be jointly compressed resulting in higher energy requirements of the compressor.

The main advantage of the controllable cooling of the oil for lubricating the compressor bearings according to the invention is in that despite use of an oil of low intrinsic viscosity, a sufficient operation viscosity of the oil serving to lubricate the bearings is achieved. Since the main oil stream located in the main oil line and provided for injection into the compressor remains uncooled, the final compression temperature is prevented from sinking to critical values and, therefore, no coolant condenses into the oil in the oil separator. In addition, by means of the cooling of the bearing oil according to the invention, the expense for cooling the oil is reduced considerably and this increases the economic efficiency.

We claim:

1. A cooling device for the bearings of a screw-type compressor having a compression space and bearings and being connected in a refrigerant circuit in which coolant is circulated through a condenser and an evaporator including in combination means including a main oil line for injecting oil into said compression space to be carried along by the coolant to be condensed to lubricate said bearings and to seal the screw type compressor, means for diverting a branched stream of coolant from said refrigeration circuit, a branch line for diverting oil from said main oil line and feeding the diverted oil to said bearings, means for sensing the temperature of the oil at said bearings and means responsive to said sensing means for cooling the oil in said branch line with said branched stream of coolant as a function of the oil temperature sensed at said bearings.

2. Device according to claim 1, characterized in that the branched stream of coolant is fed to the screw-type compressor (1) at a point (22) where the suction process of the screw-type compressor (1) is concluded.

3. Device according to claim 1, characterized in that the branched stream of coolant is fed to the suction side of the screw-type compressor (1).

4. Device according to claim 3 characterized in that the branched stream of coolant is fed to the screw-type compressor (1) at a point (22) where the suction process of the screw-type compressor (1) is concluded.

5. A cooling device as in claim 1 including means for controlling said branched stream of coolant as a function of final compression temperature.

6. Device according to claim 5 characterized in that the branched stream of coolant is fed to the screw-type compressor (1) at a point (22) where the suction process of the screw-type compressor (1) is concluded.

7. Device according to claim 5, characterized in that the branched stream of coolant is fed to the suction side of the screw type compressor.

8. Device according to claim 7 characterized in that the branched stream of coolant is fed to the screw-type compressor (1) at a point (22) where the suction process of the screw-type compressor (1) is concluded.

* * * * *